United States Patent [19]

Lieptz

[11] 4,179,806

[45] Dec. 25, 1979

[54] PILL-SPLITTING IMPLEMENT WITH NON-CRUMBLING CHARACTERISTIC

[76] Inventor: Nathan S. Lieptz, 23506 Beachwood Blvd., Beachwood, Ohio 44122

[21] Appl. No.: 866,555

[22] Filed: Jan. 3, 1978

[51] Int. Cl.[2] ..... B26B 11/00

[52] U.S. Cl. ..... 30/124; 206/528; 225/103

[58] Field of Search ..... 206/540, 238, 528; 30/124, 120.1, 120.3; 225/103, 104, 105; 83/167

[56] References Cited

U.S. PATENT DOCUMENTS

| | | | |
|---|---|---|---|
| 2,655,259 | 10/1953 | Davoren | 30/124 X |
| 3,175,746 | 3/1965 | Porter | 225/104 |
| 3,439,664 | 4/1969 | Sylvester | 225/103 X |
| 3,517,871 | 6/1970 | Gaffney | 225/103 |
| 4,009,651 | 3/1977 | Adams | 30/120.3 |

*Primary Examiner*—Jimmy C. Peters

*Attorney, Agent, or Firm*—Isler and Ornstein

[57] ABSTRACT

A pill-splitting implement or tool having self-centering means for positioning a pill in desired alignment with the path of movement of a pill-engaging projection in the form of a blade, wedge or edge. The projection is movably associated with the pill-holding structure, which preferably retains the pill in an elevated position above a support base to provide a clearance space or area underlaying the pill to enhance clean, sharp splitting of the pill. The pill holding means is preferably of a resilient character to accommodate and yield to the displacement of the pill during the splitting or dividing operation.

5 Claims, 11 Drawing Figures

PILL-SPLITTING IMPLEMENT WITH NON-CRUMBLING CHARACTERISTIC

BACKGROUND OF THE INVENTION

Most compacted powder pills used for medical purposes are disk shaped and of a predetermined size corresponding to a specific dosage. This specific dosage may be more or less than the dosage prescribed by the attending physician for the patient. For example, it is not uncommon for a physician to instruct a patient to take one half of the pill three times a day or to take one and a half pills on each of alternate days or some other dosage or frequency which involves the necessity of taking half of the pill.

In view of this common practice, pills are frequently provided with a diametrical score mark to facilitate dividing them in half. For pills which are relatively large in diameter, splitting of the pill can usually be accomplished without too much difficulty by grasping the pill between the thumb and forefinger of each hand and applying a breaking force. Even with the relatively large pills, the breaking force required is sufficiently great so that it may not be within the competence of the elderly or the feeble or those whose finger-gripping strength or ability has been impaired for such other reason.

The majority of pills are of small diameter and cannot readily be grasped in a manner to achieve the necessary leverage for breakage. Considerably more difficulty is encountered in attempting to break the small pills than is the case with the relatively larger sizes of pills, even for persons who are not unduly enfeebled or handicapped. For these smaller pills, most patients find it necessary to use a kitchen knife or similar implement to shear the pill or score it to a greater extent where it can be broken between the fingers. The pill is placed upon a supporting surface and, when the knife is applied to it, more often than not the pill does not separate cleanly into two halves, but crumbles into several parts.

Apart from the inconvenience, irritation and frequent crumbling of the pill when using these methods of pill splitting, there is also the possibility of having the pill drop or slip and be lost or contaminated, as well the more serious problem of possible injury if the knife slips.

SUMMARY OF THE INVENTION

It is the primary object of the invention to provide a pill-splitting implement which will position and retain a pill in a manner to permit it to be split or divided without the application of great force and which will produce a clean, sharp fracture of the pill into two equal parts, which can be further subdivided.

Another object of the invention is to provide a pill dividing implement having a mechanical advantage which requires the use of little strength or force on the part of the user.

A further object of the invention is to provide self-centering means for positioning a pill in the implement.

Still another object of the invention is to provide a pill-splitting implement of small but effective size, which can conveniently be carried in the pocket or purse of the user.

Other objects and advantages of the invention will become apparent during the course of the following description.

BRIEF DESCRIPTION OF THE DRAWINGS

In the drawings, in which like reference numerals designate like parts throughout the same.

DESCRIPTION OF THE PREFERRED EMBODIMENTS

Figure 1:
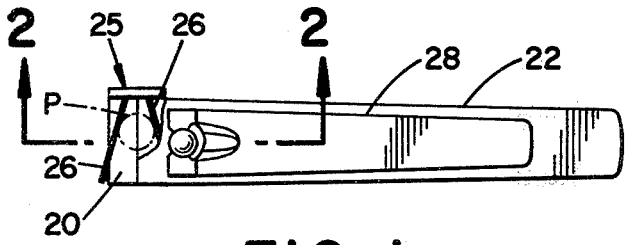
FIG. 1 is a view in elevation of a pill-dividing implement embodying the features of the invention, portions thereof being broken away to show interior detail.
Figure 2:
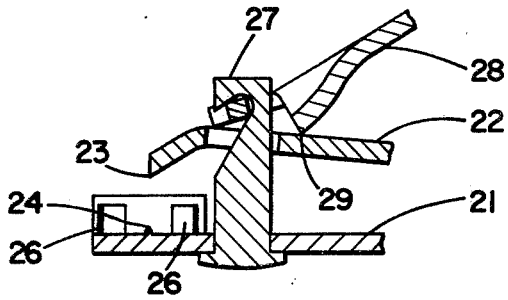
FIG. 2 is an enlarged cross-sectional view taken as indicated on line 2—2 of FIG. 1.

Referring to FIGS. 1 and 2 of the drawings, there is shown a pill-dividing tool provided with a pill support base 20 at one end of a support arm 21. The other end of the support arm is joined to another arm 22 which is in the form of a resilient leaf spring which diverges from its joinder with the support arm 21 to extend in spaced overlying relationship to the base 20.

The free end of the arm 22 is provided with an inwardly extending projection or knife-edge portion 23 which is in substantial alignment with a transversely extending projection or ridge 24 which extends centrally of the base 20. Mounted on the base 20 is a substantially U-shaped spring steel retaining clip 25 providing a pair of resilient oppositely disposed retaining arms 26 which diverge from each other and extend substantially parallel to the surface of the base 20. The arms 26 are disposed to be substantially equi-distant from the central ridge 24 of the base.

An anchor post 27 is secured to the support arm 21 and extends through the arm 22 into pivotal connection with an operating lever arm 28. When the free end of the lever 28 is depressed or moved toward the arm 22, its fulcrum 29 causes the free end of the arm 22 and its knife-edge 23 to be displaced with compounded force toward the support base 20. A pill P, shown in phantom outline, can be placed on the base 20 so as to be retained between the opposed arms 26 of the spring clip 25. By reason of the substantially equal resilient characteristic of the spring arms 26, they provide a self-centering function for positioning the pill so that its diametrical plane is substantially coincident or aligned with the transverse projection 24 on the base. When the linear, wedge-shaped knife-edge 23 is forced into shearing engagement with the upper surface of the pill, an effective, substantially instantaneous splitting force is applied to separate the pill into two equal halves. The projection or ridge 24 elevates the bottom of the pill above the main surface of the base 20 to provide a clearance space beneath the pill as the splitting force is applied. The wedge or taper of the knife-edge 23, acting as an inclined plane, impresses a separating force of large magnitude on the upper surface of the pill and this action is complemented by the taper or wedge shape of the opposed ridge 24 on the underside or bottom of the pill.

As the pill is subjected to these diametrically aligned splitting forces, the fractured halves of the pill are forced to pivot downwardly relatively to each other as the wedge penetration of the projection 23 increases and causes greater separation of the pill adjacent its upper surface than ordinarily occurs adjacent its lower surface. The slight elevation of the pill above the main surface of the base 20 provides the clearance space to accommodate this movement of the separating halves of the pill without subjecting the pill to a compressive force adjacent its bottom surface periphery, which would cause crumbling of the edges of the pill if such clearance were not provided.

Furthermore, as the knife-edge splitting wedge penetrates the upper surface of the pill it causes lateral displacement of the halves of the pill in a direction substantially normal to the knife-edge. If the pill were solidly and firmly restrained against movement, this displacement would create a undesired compressive force on the pill in opposition to the splitting action of the knife-edge 23 and would cause multiple fracturing or crumbling of the pill. However, the resilient retaining arms 26 yieldably accommodate to the displacement of the pill halves during the splitting action and self-adjust in response to increased wedge separating action on the pill. Therefore, there is no substantially increased compressive force acting upon the pill to create multiple fractures or crumbling as the splitting action progresses and a clean, sharp division of the pill is quickly and easily achieved. The resilience of the spring arms 26 also permits these retaining arms to self-adjust to pills of various diameters over a substantially wide range of commonly used pill sizes, thus avoiding the necessity of specially adjusting or preparing the base for the support and retention of a particular pill size. It should be noted that after a whole pill has been split into halves and removed from the implement, either one of the halves can be reinserted into the implement and further split into quarters, if desired, preferably positioning the pill so that its sheared diameter is normal to the knife-edge 23, equivalent to being 90° removed from its previous position when being split as a whole pill. If desired, the pill-retaining surfaces of the arms 26 can be roughened, corrugated, serrated or otherwise treated to enhance their gripping action.

By using a pivotally mounted anchor post 27, the lever arm 28 can be rotated 90° and pivoted back over the post into storage position, to make a small, compact, yet highly effective pill dividing tool which can easily be carried on the person for ready use.

Figure 3:
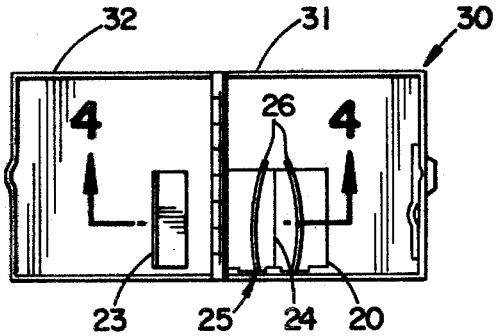
FIG. 3 is a view in elevation of a modified form of the invention.
Figure 4:
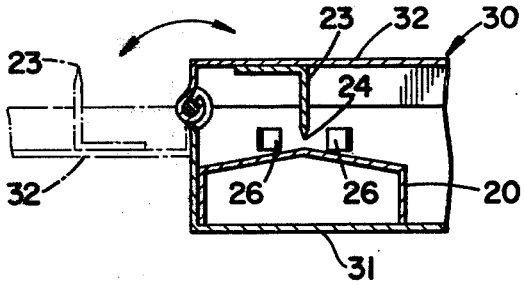
FIG. 4 is an enlarged cross-sectional view taken as indicated on line 4—4 of FIG. 3, with the lid of the pill container in closed position.

FIGS. 3 and 4 of the drawings, there is shown a modified form of the pill-dividing implement concealed and carried within a pill box or container 30 having a container body portion 31 and a lid 32 hingedly connected to one end of the body 31.

In this form of the invention, the support base 20 having the central ridge 24 and the spring steel pill-retaining clip 25 with resilient arms 26, is mounted within the container body 31. The wedge shaped knife-edge 23 is mounted on the interior surface of the lid 32. As the lid is swung closed over the body of the container, the knife-edge 23 moves in an arcuate path which brings it toward the base 20 in alignment with the ridge 24.

As in the previously described form of the invention, the self centering retaining arms 26 hold the pill central of the ridge 24 so that the knife-edge 23 and the underlaying ridge 24 are coincident with the diametrical plane of the pill. If a pill is placed between the arms 26 on the base 20 and the lid 32 is swung towards closed position, the previously described splitting action occurs and the pill is cleanly and sharply separated into equal halves without crumbling. This form of the invention provides an extremely convenient pill-splitting implement concealed within the pill box and therefore available for use whenever and wherever access is had to the pill box.

Figure 5:
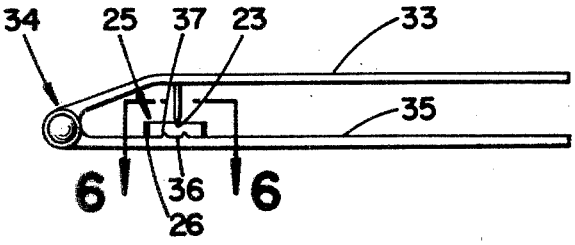
FIG. 5 is a view in elevation of another form of the invention.
Figure 6:
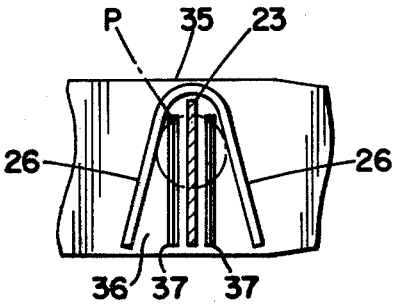
FIG. 6 is an enlarged cross-sectional view taken as indicated on line 6—6 of FIG. 5.

Although reference has been made to the resilient retaining members as being spring arms 26, it will be understood that this is only convenient and simple form of resilient retaining means and that the invention contemplates that other forms of yieldable or spring loaded members could be utilized, of which the resilient clip arrangement 25 is merely a simple, economical and readily available form. In FIGS. 5 and 6 of the drawings there is shown still another form of the invention which utilizes three point splitting engagement with the pill instead of the two point engagement of the previously described forms of FIGS. 1 and 3. It will be noted that in the forms of FIGS. 1 and 3, the ridge 24 provided one point or line of engagement of the pill and the knife-edge 23 provided the other point or line of engagement for splitting action, the two lines or points reacting against each other to cause division of the pill. In the form of the invention shown in FIG. 5, the knife-edge 23 is carried by one arm 33 of a lever implement or tool 34 having a second arm 35 pivotally connected to the arm 33 at one end thereof. The free ends of the arms 33 and 35 provide hand grips for manipulation of the tool.

A support base 36 for the pill is mounted upon and carried by the lever arm 35, in opposition to movement of the projection or knife-edge 23 of arm 33, and has mounted thereon the previously described retaining clip 25 having the resilient arms 26.

A pair of projections 37 extend uprightly from the surface of the base 36 and are spaced from each other so as to be substantially equi-distant on opposite sides of the diametrical plane defined by the knife-edge 23 as it engages the retained pill P.

It will be apparent that when the pill P is placed on the support base 36 between the pill-centering arms 26, the bottom surface of the pill will be elevated above the main surface of the base by means of the projections 37. As the lever arms 33 and 35 are drawn toward each other, the blade 23 engages the retained pill and cleanly divides it, the yieldable retaining arms 26 and the clearance space under the pill serving to accommodate the displacement of the pill and prevent the imposition of undesired compressive forces that would create multiple fractures and crumbling of the pill.

Although it is not considered necessary, it will be understood that any suitable form of spring loading may be used between the arms 33 and 35 to obtain automatic return and release of the arms after the splitting operation of the pill has been completed.

Figure 7:
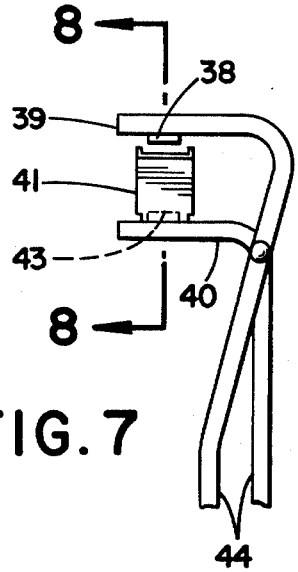
FIG. 7 is a view in elevation of still another form of the invention.
Figure 8:
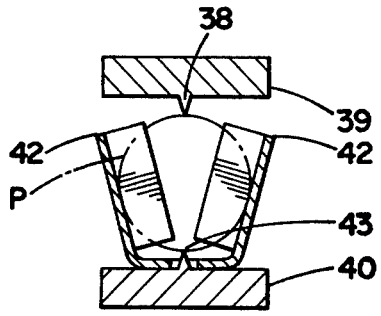
FIG. 8 is an enlarged cross-sectional view taken as indicated on line 8—8 of FIG. 7.

In the three forms of the invention described above, the bottom surface of the pill has been supported in elevated position on a base in opposition to the action of a wedge or knife blade which moves downwardly into engagement with the upper surface of the pill. In FIGS. 7 and 8 of the drawings, there is shown a modified form of the invention in which the direction of the splitting action still remains in the diametrical plane of the pill but is in a direction normal to that previously described, that is the splitting action of the wedge or blade is directed towards the opposed edges of the pill rather than to its upper and lower surfaces. As illustrated in FIGS. 7 and 8, a projection or wedge 38, comparable to the previously described knife-edge 23, is mounted on one lever arm 39 which is pivoted to another lever arm 40 of a pincher type tool having high mechanical advantage.

The inner face of the lever arm 40 has mounted thereon a modified form of spring clip 41 which presents spaced resilient pill retaining arms 42 of arcuate or channel-like cross-section. Traversing and extending upwardly through the clip 41, between the arms 42, is another projection or wedge blade 43 which extends in the same direction as the arms 42 and in opposition to the wedge projection 38.

The pill P is placed into the retaining channel provided by the self-adjusting spring arms 42, so as to bring a point on the periphery or edge of the pill into a position of rest on the element 43. When the operating handles 44 of the implement are gripped and drawn toward each other, the wedge element 38 is brought into engagement with the peripheral edge of the pill at a point diametrically opposed to its engagement with the wedge blade 43. Both the elements 38 and 43 act in opposition to each other to split and separate the pill along its diametrical plane. The pill is divided sharply and cleanly without crumbling, as there are no solid abutments which would exert compressive forces upon the pill as its halves are displaced during the splitting action.

Figure 9:
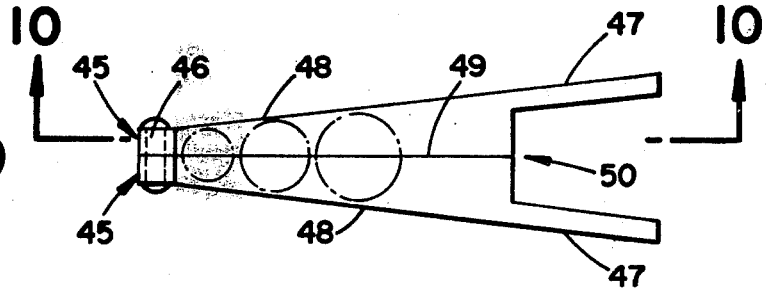
FIG. 9 is a view in front elevation of another modified form of the invention.

In each of the four forms of the invention previously described, a wedging action and impact force has been utilized to effect the splitting of the pill. In the form of invention illustrated in FIGS. 9 and 10 of the drawings, the splitting implement is designed to produce a shear effect on the pill to divide the pill. The implement includes two like arms 45 of channel cross-section and triangular configuration so as to provide a taper. At their narrow ends, the arms 45 are pivotally secured to each other as at 46 for relative movement out of the plane defined by the arms when they are in their closed position. The opposite ends of the arms 45 are slit and formed to provide operating handles 47. Thus, as shown in FIG. 9, the opposed channels 48 of the arms in the closed position provide, in combination, a progressively tapered narrowing retaining recess for accommodation and containment of a pill.

Figure 10:
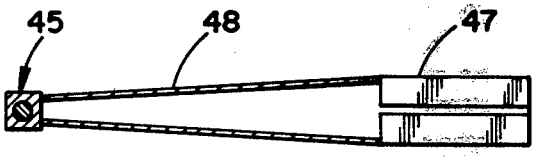
FIG. 10 is a cross-sectional view taken as indicated on line 10—10 of FIG. 9.

As best seen in FIG. 10 of the drawings, the height dimension of the channels 48 is also progressively decreased from the wide end of the arms toward the narrow end of the arms. Thus the combination of the opposed channels not only provides a tapered recess to accommodate varying diameters of pill, but also is tapered correspondingly for the lesser thickness of the pills of smaller diameter. The central abutting edges 49 of the channel arms 45 serve as the shear blades for splitting the pill.

A pill is slideably inserted into either one of the arms 45 or may be inserted into both of the arms 45 through the opening 50 when the implement is in its closed position. The pill is slideably received in the channel recess and comes to rest at a point dictated by its diameter and thickness in relation to the recess in which it is slideably received. The recess causes the pill to be centered within the implement so that the shearing edges 49 are aligned with the diameter of the retained pill. When the operating handles 47 are manipulated to pivot and displace one of the arms 45 out of the plane of the other arm 45, the edges 49 shear the contained pill in its diametrical plane. If the user takes and is required to split pills of significantly different sizes, this form of pill dividing implement can obviously be utilized to shear two pills simultaneously, provided their sizes are such that they are accommodated in spaced relationship to each other within the channels 48 of the implement.

Figure 11:
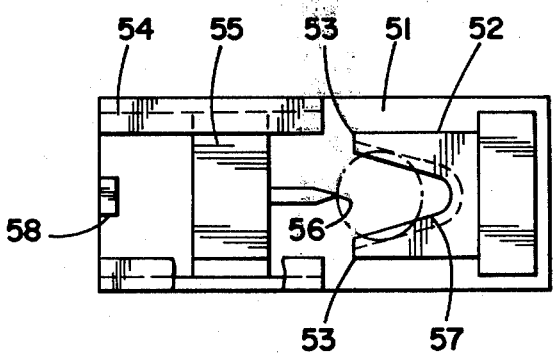
FIG. 11 is a plan view of still another form of the invention.

FIG. 11 of the drawings shows a form of pill-splitting implement providing a pill-support base 51 on which is mounted a forked pill retaining member 52 made of a resilient or elastomeric material so as to present two spaced resilient or deformable divergent retaining arms 53.

An end of the support base 51 opposite to the retaining member 52 is provided with a channel or track 54 in which is slideably mounted a block 55 provided with a wedge shaped projection 56 directed toward a point mid-way between the resilient retaining arms 53.

The retaining arms 53 are grooved to provide a channel 57 to accommodate and receive the edge of a pill that is positioned therein. When a pill is so positioned, the block 55 is moved toward the member 52 so as to engage the wedge blade 56 with the edge of the pill on a diametrical plane thereof. As the wedge increasingly penetrates the pill, a splitting action of the pill occurs on the diametrical plane and the arms 53 resiliently accommodate to the separation of the two halves of the pill so as to prevent crumbling or multiple fracture.

An abutment or stop 58 is provided on the support base 51 adjacent one end thereof to prevent inadvertent withdrawal of the block 55 from its sliding engagement with the support base 51. If desired, the block 55 may be tension spring-loaded to withdraw the block from pill splitting position after the function has been performed.

It is to be understood that the forms of my invention, herewith shown and described, are to be taken as preferred examples of the same, and that various changes in the shape, size and arrangement of parts may be resorted to, without departing from the spirit of my invention, or the scope of the subjoined claims.

I claim:

1. In a pill-dividing device, the combination of a first means providing a support surface for holding a pill in position to be split, second knife-edge means pivotally connected to said first means for arcuate movement into pill-dividing engagement, pill-positioning members associated with said first means for adjustably centering the pill on said support surface into a position of predetermined alignment with said pill-dividing movement of said second knife-edge means, and said pill-positioning members including a pair of spaced movable arms resiliently biased for pill-engaging movement toward each other in the diametrical plane of the supported pill, said arms being yieldably displaceable away from each other in response to knife-edge induced displacement of the divided pill portions.

2. A combination as defined in claim 1, including a pill-engaging projection provided on said support surface to maintain the underside of the pill in elevated spaced relationship to said support surface whereby to establish a clearance space therebetween during pill-dividing engagement by said knife-edge means.

3. A combination as defined in claim 2, wherein said projection is in the form of a wedge.

4. A combination as defined in claim 2, wherein said projection is in aligned opposition to said second means.

5. A combination as defined in claim 1, including a pill container, having a hinged lid provided thereon, one of said means being carried by said lid, and the other of said means being mounted in the path of movement of said one means.

* * * * *